US009371670B2

(12) United States Patent
Schönenberg et al.

(10) Patent No.: US 9,371,670 B2
(45) Date of Patent: Jun. 21, 2016

(54) LOCKING SYSTEM

(75) Inventors: Thomas Schönenberg, Burscheid (DE); Hendrik Wahmann, Düsseldorf (DE)

(73) Assignee: Kiekert Aktiengesellschaft, Heiligenhaus (DE)

( * ) Notice: Subject to any disclaimer, the term of this patent is extended or adjusted under 35 U.S.C. 154(b) by 292 days.

(21) Appl. No.: 14/110,246

(22) PCT Filed: Mar. 24, 2012

(86) PCT No.: PCT/DE2012/000317

§ 371 (c)(1),
(2), (4) Date: Dec. 9, 2013

(87) PCT Pub. No.: WO2012/139544

PCT Pub. Date: Oct. 18, 2012

(65) Prior Publication Data

US 2014/0091580 A1 Apr. 3, 2014

(30) Foreign Application Priority Data

Apr. 9, 2011 (DE) ..... 20 2011 005 086 U

(51) Int. Cl.

| | |
|---|---|
| ***E05C 3/06*** | (2006.01) |
| ***E05B 83/36*** | (2014.01) |
| ***E05B 15/00*** | (2006.01) |
| ***E05B 81/16*** | (2014.01) |

(Continued)

(52) U.S. Cl.

CPC ..... *E05B 83/36* (2013.01); *E05B 15/0053* (2013.01); *E05B 81/16* (2013.01); *E05B 81/30* (2013.01); *E05B 81/34* (2013.01); *E05B 81/36* (2013.01); *E05B 81/06* (2013.01); *E05B 2015/0458* (2013.01); *E05B 2015/0496* (2013.01); *Y10T 292/108* (2015.04)

(58) Field of Classification Search

CPC ..... Y10T 292/108; E05B 15/04; E05B 81/50; E05B 81/00; E05B 15/0053; E05B 81/16; E05B 81/30; E05B 81/34; E05B 81/36; E05B 2015/0458; E05B 2015/0496; E05B 81/06; E05B 83/36

USPC ..... 292/201, 144, 216, DIG. 61; 74/89.14, 74/425, 816, 63

See application file for complete search history.

(56) References Cited

U.S. PATENT DOCUMENTS 3,979,144 A * 9/1976 Bascou ..... E05B 83/16 292/210
2011/0012375 A1 1/2011 Graute

FOREIGN PATENT DOCUMENTS

CA WO 2009030046 A1 * 3/2009 ..... E05B 81/06
DE 197 13 864 C2 9/1999
DE 102007055413 A1 * 5/2009 ..... E05B 77/24

(Continued)

*Primary Examiner* — Kristina Fulton
*Assistant Examiner* — Christine M Mills
(74) *Attorney, Agent, or Firm* — Renner, Otto, Boisselle & Sklar, LLP

(57) ABSTRACT

The invention relates to a locking system, in particular motor vehicle door lock, with at least one lever (1), and with a position-securing unit (5, 6, 7, 8) for the lever (1), wherein the position-securing unit (5, 6, 7, 8) has at least one spring element (5) and is designed for defining at least one stable position (E) of the lever (1), wherein the spring element (5) reaches through the lever (1) in the region of an opening (8), and wherein the opening (8) permits pivoting movements of the lever (1) in relation to the spring element (5) within a predetermined pivoting angle range (9).

11 Claims, 5 Drawing Sheets

Figure 1:
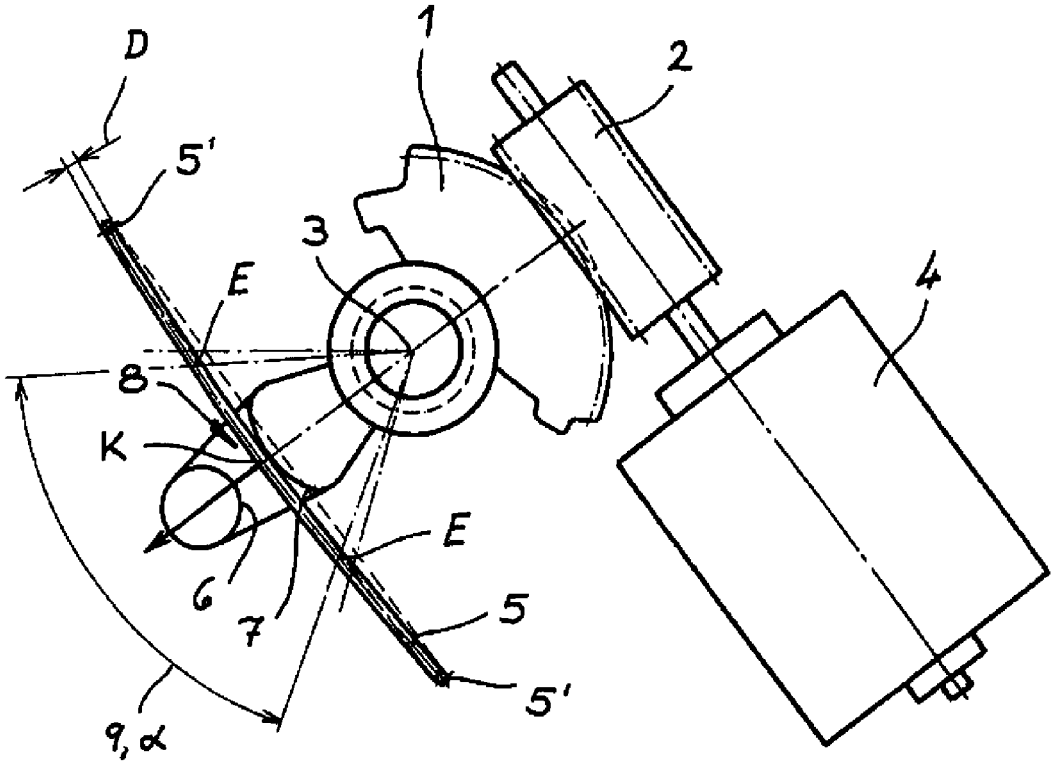

(51) Int. Cl.

| | |
|---|---|
| ***E05B 81/30*** | (2014.01) |
| ***E05B 81/36*** | (2014.01) |
| ***E05B 81/34*** | (2014.01) |
| *E05B 81/06* | (2014.01) |
| *E05B 15/04* | (2006.01) |

(56) References Cited

FOREIGN PATENT DOCUMENTS

| | | | | |
|---|---|---|---|---|
| DE | 10 2008 011 545 A1 | | 9/2009 | |
| FR | EP 1201851 A1 * | | 5/2002 | ..... E05B 85/14 |

* cited by examiner

LOCKING SYSTEM

The invention relates to a locking system, in particular a motor vehicle door lock, with at least one lever and with a position-securing unit for the lever, wherein the position-securing unit has at least one spring element and is designed for defining a stable position of the lever.

In a locking system of the aforementioned design according to DE 10 2008 011 545 A1 the spring in connection with the respective profile on the lever both combine to form the bi-stable position-securing unit. For this purpose, the spring is a leg spring with two spring legs. A journal is provided to support and carry the spring or leg spring, said journal extending through a respective spring coil.

As part of an also generic teaching according to DE 10 2007 055 413 A1, a locking system with a multi-stable component spring element is described. In this arrangement a cam section is provided on a component, being displaced along a motion path between at least a first stable position and a second stable position. In this case, the spring element is clamped between a fixed bearing and a floating bearing and is formed from a simple straight spring wire, bent by 90° at both ends.

In prior art embodiments the spring element always carries out more or less pronounced movements upon assuming at least one stable position or during a change of position. DE 10 2008 011 545 A1 discloses indeed a pivoting movement of the leg spring around the journal extending through the coil. In the teaching disclosed in DE 10 2007 055 413 A1 at least one type operates in such a way that the spring element carries out a more or less pronounced linear movement at least in the area of the floating bearing.

The described pivoting or linear movements of the spring element are carried out in addition to the anyhow obligatory and resilient deformations of the spring element and are added to these. As a result this can lead to fatigue of the spring element in case of intensive and long-term use or the danger exists that the spring element can no longer or no longer fully carry out the desired function. This means that in the long term the reliable functioning of prior art embodiments cannot be guaranteed. The invention aims to remedy this situation.

To solve this technical problem, a generic locking system is, as part of the invention, characterised by the spring element extending through the lever in the region of an opening, wherein the opening permits pivoting movements of the lever in relation to the spring in a predetermined pivoting angle range.

According to an advantageous embodiment, the spring element is predominantly produced from a straight spring wire. In most cases the spring element is also clamped at each end point. An intermediate area remaining between the two end points can on the other hand be elastically deformed, with the lever interacting with the spring element producing the desired elastic deformation of this intermediate area.

As part of the invention, first of all a spring element mainly in form of a straight spring wire is used and is clamped at its end points. As a result, not even basic linear movements, rotations, etc. of the spring element are possible during operation, so that the said fatigue problems can not or can no longer appear. At the same time the invention uses the elasticity of the spring to produce at least one stable position of the lever.

In most cases, the position-securing unit has a bi-stable design. This means that the lever can be pivoted into two stable positions, with the two in each case stable positions being defined by the lever interacting with the spring element. In detail this is achieved by the spring or the spring element extending through the opening in the lever and the opening being designed in such a way that the described pivoting movements of the lever are permitted. In most cases the lever can be pivoted from one stable position to another stable position, with the angle range between these two stable positions representing the predetermined pivoting angle range.

In order to achieve this in detail, the opening in the lever advantageously contains two mainly opposed and spaced apart contact surfaces for the spring element. In order to allow the lever to pivot in relation to the spring element extending through it, taking into consideration the predetermined pivoting angle range, the contact surfaces typically contain a gap, equal to a multiple of the diameter of the spring element. As already explained, the spring element is predominantly designed as a spring wire and is predominantly made from such a straight spring wire. The straight spring wire typically has a cylindrical shape with a circular cross section and a respective diameter. In most cases the diameter of the spring element fits at least twice or even three times next to each other between the contact surfaces defining the opening in the lever.

In other words, the distance between the two said contact surfaces is, for instance two times or three times greater than the diameter of the spring element. Naturally also decimal point multiples are feasible and are covered, e.g. in such a way that the gap is equal to 1.5 times, 2.5 times the diameter of the spring element.

The two contact surfaces defining the opening in the lever have different designs. In actual fact the contact surfaces are, on one hand, a deflection surface and, on the other hand, a contact surface. The deflection surface abuts the spring element during all pivoting movements of the lever. The contact surface, on the other hand, only moves against the spring element to define the stable position.

This design explains that the deflection area deflects the spring element or the straight spring wire between the two stable positions on one side, i.e. in one direction, as the spring wire or the spring element is clamped at each of its end points, so that the deflection area acting on the spring element ensures the described elastic deformation of the spring element in one direction, i.e. on one side. In the respective stable position the spring element is, however, essentially not deflected. This means that in this stable position the deflection surface does not or does hardly act on the spring element.

In this way a tipping point of the lever is created between the two stable positions. In the area of this tipping point the spring element experiences a maximum single-sided deflection by means of the deflection surface.

The tipping point corresponds indeed to the spring element generating a maximum force that counteracts the lever as a result of the maximum deflection, so that the lever always strives to move into one or the other direction in comparison to the tipping point, as in both directions from the tipping point the counterforces generated by the spring element is smaller than in the area of the tipping point. This explains that the position-securing unit is bi-stable, as the two respective stable positions correspond to the spring element exerting no or at most a small counterforce on the lever and said lever consequently advantageously assumes the respective stable position.

Generally, the tipping point is located at the centre between the two stable positions. This central position is provided in contrast to the pivoting angle range. In addition to the predetermined pivoting angle range each with a stable position at its end and central tipping point, an overtravel range exists beyond each stable position. In this overtravel range, the spring element is subjected to a two-sided deflection. This means that in the overtravel range the spring element is deflected in two directions, radially upwards and radially inwards in comparison to a pivot point or an axis of rotation of the lever or pivot lever mounted on the respective axis. In contrast, the spring element is only subjected to a radial upward deflection at the tipping point and between the two stable positions.

The deflection of the spring element in the overtravel area in radial outward and radial inward direction causes the spring element to follow a near S-shaped route in this overtravel range. As a result, the spring element creates particularly strong counterforces affecting the lever, acting upon the lever to return it to a stable position. The two overtravel ranges on each side of the stable position thus also represent resilient end stops so that the lever does expressly not move against any fixed mechanical end stops. Instead the end stops are, to put it another way, resilient stops in the form of the respective described overtravel ranges. These overtravel ranges correspond to a two-sided deflection of the spring element and thus to the lever located in each case in the overtravel range being subjected to a force in the direction of the stable position.

Such a design is particularly advantageous given that the lever is typically a pivoting lever mounted on said axis. Also, the lever contains in most cases a motor drive, causing a certain self-inhibiting of the lever. In other words, the counterforces generated by the spring element support a motorized movement of the lever in the direction of the stable position or act against a motorised movement of the lever past the stable position. As soon as the motorised drive moves the lever past the stable position, the counterforces generated in this case by the spring element in the respective overtravel range ensures that the motorized drive and with it the lever are, as it were, turned back. This explains the function of the thus realized resilient end stops.

In this way the locking system of the invention can be used particularly advantageously for the realization of a worm gear drive. This means that the lever including motorized drive operates advantageously as a worm gear drive that can, for example, be used with a locking lever, a theft protection lever, etc. of a motor vehicle door lock. In this arrangement mechanical end stops are expressly not required, as the locking system of the invention contains alternative resilient end stops. This increases the service live and functional reliability, in particular as the spring element of the invention—in contrast to prior art embodiments—no longer experiences fatigue. These are the main advantages of the invention.

Figure 2:
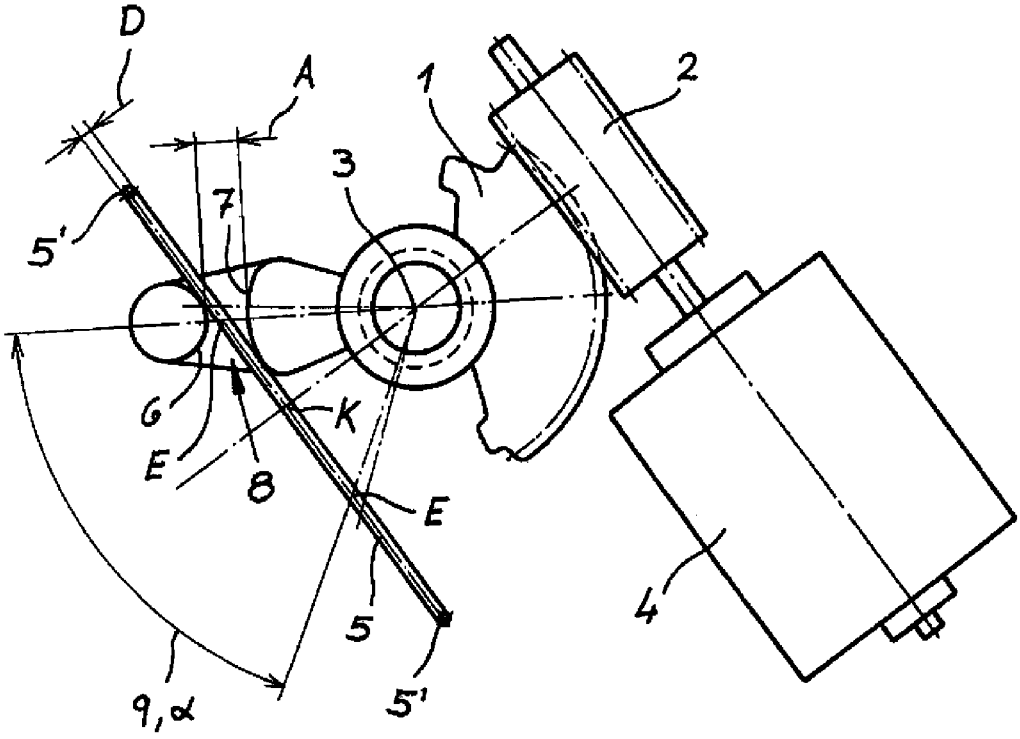
Figure 3:
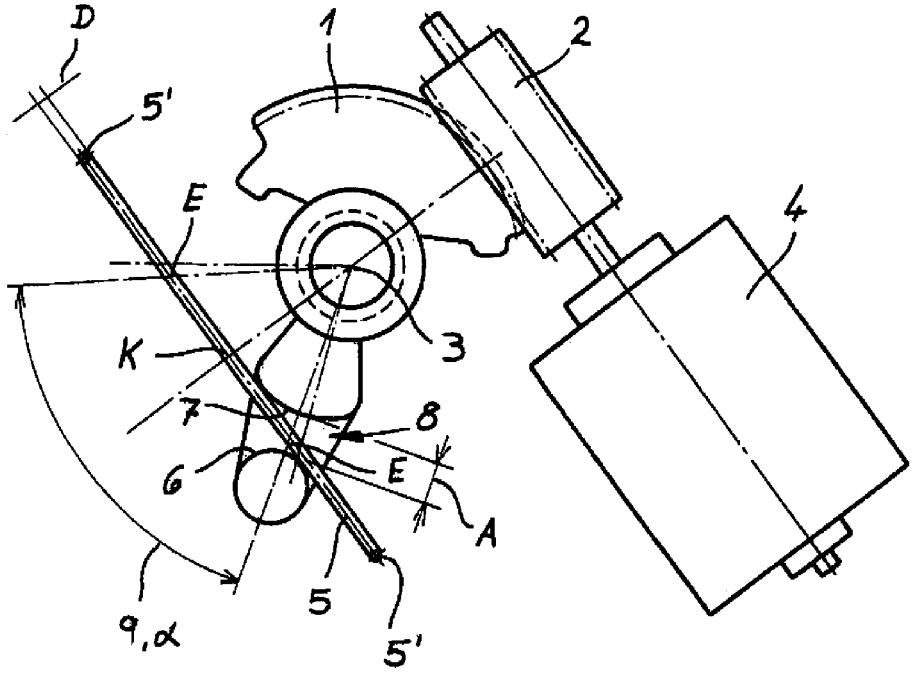
Figure 4:
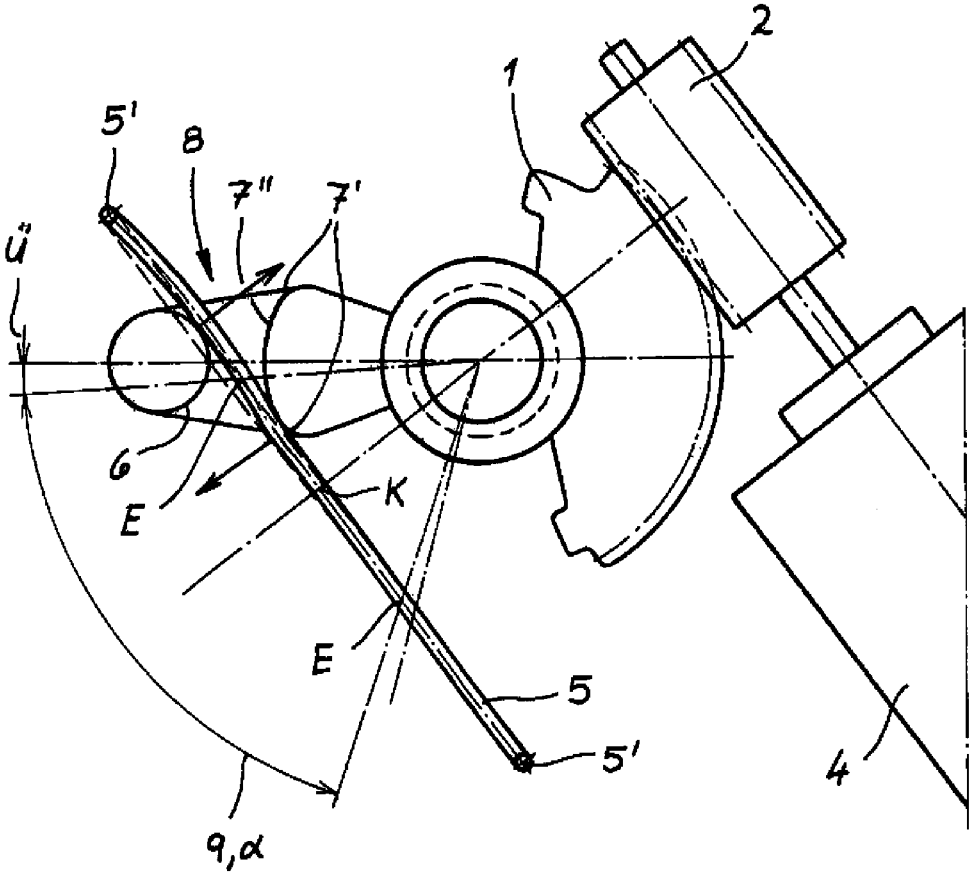
Figure 5:
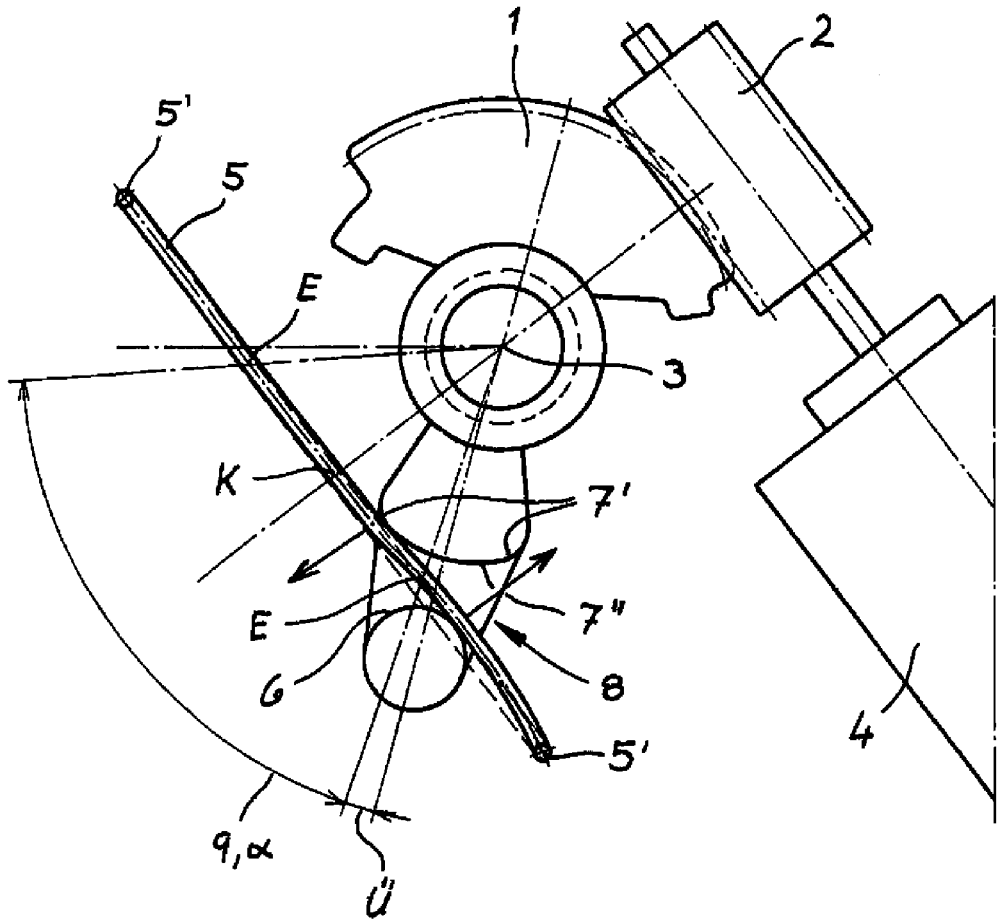

Below, the invention is explained with reference to a drawing showing only one embodiment, in which:

FIGS. 1 to 3 show the locking system of the invention in different functional positions, taking into consideration a given pivoting angle range and FIGS. 4 and 5 show the locking system of FIGS. 1 to 3 in each case in an overtravel range or the functioning of the resilient end stops.

The figures show a locking system and in this case a section of a motor vehicle door lock. The figures only show a worm gear 1 of this motor vehicle door lock, which is rotated around an axis 3 with the aid of a worm 2. For this purpose the worm gear 2 is connected to an output-side drive shaft of a motorized drive 4. The motorized drive 4 can be acted upon by a control unit—not shown.

Also, the worm gear 1 can act upon a not specifically shown central locking lever, a theft-protection lever, etc. or can coincide with such a lever.

The general function can be designed as disclosed in DE 197 13 864 C2 of the applicant. In addition, reference is made to the already mentioned printed publications DE 10 2008 011 545 A1 and DE 10 2007 055 413 A1. In any case the locking system of the invention shown in parts in the figures is typically arranged in motor vehicle door lock or is congruent with it. This does, however, not limit the scope of the invention.

The worm gear 1 or the lever 1 realised at this point is—as already mentioned—a lever or a pivoting lever 1, mounted on an axis 3, which can carry out pivoting movements around this axis 3. The pivoting movements of the leverl are restricted by a position-securing unit 5, 6, 7, 8 for the lever 1. The position-securing unit 5, 6, 7, 8 contains at least a spring element 5. Also, the positioning securing unit 5, 6, 7, 8, serves to define at least one stable position E of the lever 1.

The embodiment contains two stable positions E of the lever 1, a first stable end position E as shown in FIG. 2 and a second stable end position E as shown in FIG. 3. Between these two stable end positions E the lever 1 passes through a predetermined pivoting angle range 9, corresponding to an associated pivoting angle $\alpha$. In the embodiment, the pivoting angle $\alpha$ is 60° to 80°, in particular approx. 70°.

The spring element 5 is in this case designed as a straight spring wire 5. Also the spring element 5 is clamped at the respective end points 5'. For this purpose, the straight spring wire 5 can be angled by 90° compared to the plane of projection in the area of its end points 5' and can be anchored in a lock housing not shown. In any case the spring element 5 or the straight spring wire 5 of the invention do not carry out a linear movement due to the fixed clamping at the two respective end points 5'.

It is apparent from the figure that the spring element 5 extends through the lever 1 in the region of an opening 8. At the same time, the opening 8 permits pivoting movements of the lever 1 compared to the spring S or the spring element 5 in the predetermined pivoting angle range 9. In order to achieve this in detail, two spaced apart contact surfaces 6, 7, essentially facing each other, are provided for the spring element 5 in the area of the opening 8.

The two contact surfaces 6, 7 are separated by a gap A that is a multiple of the diameter D of the spring element 5. The spring element or the straight spring wire 5 is indeed cylindrical with a circular cross section. In the embodiment, the gap A between the two contact surfaces 6, 7 is approx. three times as wide as the diameter. Which means:

$$A=3D.$$

In this way the lever or the pivoting lever 1 can carry out the pivoting movement shown in FIGS. 1 to 3, taking into consideration the predetermined pivoting angle range 9' and the respective pivoting angle $\alpha$.

One contact surface 7 is designed as a deflection surface 7, whilst the other contact surface 6 is a contact surface 6. A comparison of FIGS. 1 to 3 shows that during all pivoting movements of the lever 1 the deflection surface 7 abuts the spring element or the straight spring wire 5. In contrast, the contact surface 6 only moves against the spring element 5 to define the respective stable position E as shown in FIGS. 2 and 3. This means that as soon as the contact surface 6 moves against the spring element 5, the stable position E as shown in FIG. 2 or in FIG. 3 is assumed by the lever or pivoting lever 1.

The deflection surface 7 ensures that the spring element 5 is deflected between the already set out stable positions on one side, i.e. in one direction. In this case the spring element or the straight spring wire 5 is radially outwardly deflected by the deflection surface 7 in comparison to the axis of rotation 3 of the pivoting lever 1. This is indicated in FIG. 1 by an arrow 1 and is indicated in FIGS. 1 to 5 by the dashed or dashed/dotted line representing the undeflected course of the spring element or of the straight spring wire.

It is apparent that the spring element 5 in the area of the tipping point K as shown in FIG. 1 is subjected to a maximum one-sided radial outwardly deflection. At the same time the tipping point K lies between the stable positions E as shown in FIG. 2 and FIG. 3, i.e. the respective end positions E corresponding therewith. In relation to the predetermined pivoting angle range 9 the tipping point K is located approximately in the centre between the two stable positions or between the two end positions E.

As soon as the pivoting lever 1 is moved beyond the stable positions or the end positions E, as shown in FIGS. 4 and 5, the lever or the pivoting lever 1 moves into an overtravel range Ü. In this range beyond the stable position E or in the overtravel range Ü, the spring element 5 is deflected on two sides. The spring element 5 is indeed displaced on one hand in radial outward direction and, on the other hand, in radial inward direction in the overtravel range Ü. This is indicated by respective arrows in FIGS. 4 and 5.

The radial downwards deflection is again produced by the deflection surface 7, whilst the contact surface 6 ensures that the spring element 5 is also acted upon in radial inward direction. As a result, the spring element follows a near S-shaped route in and also beyond the overtravel range Ü. As a result of this S-shaped route of the spring element 5, considerable resetting forces are applied to the lever 1 in direction of the respective end position E, pivoting, as it where, the lever or pivoting lever 1 back in direction of the end position E around axis 3 or acting upon it in this direction. The forces can be of such strength that, where applicable, even the drive 4 for lever 1 is turned back.

As a result, the described locking system is also equipped with elastically designed end stops or resilient end stops becoming effective in the overtravel range. This is due to the fact that as soon as the lever 1 is moved into the respective overtravel range Ü beyond the respective stable end position E, these forces cause the pivoting lever 1 to be acted upon by reversing forces due to the S-shaped deformation of the spring element 5.

The above explanations show that the two contact surfaces 6, 7 in connection with the opening 8 in the lever 1 in combination with the spring element 5 produce and can also produce the described positioning of the lever or pivoting lever. Consequently, the two contact surfaces 6, 7 together with the opening 8 and the spring element 5 define the already mentioned position-securing unit 5, 6, 7, 8. The contact surface 6 mainly has a circular shape, whilst the deflection surface 7 is T-shaped with in each case two arched end sections 7' and a predominantly straight middle section 7". As long as the lever 1 moves within the predetermined pivoting angle range 9 the lightly arched middle section 7" provides the radial outward deflection of the spring element 5. In contrast, the arched end sections 7' of the deflection surface 7 predominantly come into effect when the lever 1 moves into the respective overtravel range Ü.

The invention claimed is:

1. Locking system, for use in a motor vehicle door lock, the locking system comprising:

at least one lever; and a position-securing unit for the lever, wherein the position-securing unit has at least one spring element and is designed for defining at least one stable position of the lever, wherein the spring element extends through an opening in the lever and wherein the opening permits pivoting movements of the lever in relation to the spring element within a predetermined pivoting angle range;

wherein the opening in the lever is defined by two spaced apart contact surfaces, essentially facing each other and on opposite sides of the spring element, between which the spring element linearly extends;

wherein the spaced apart contact surfaces comprise a deflection surface and a contact surface, with the deflection surface abutting the spring element during all pivoting movements of the lever, whilst the contact surface only moves against the spring element to define the stable position; and wherein the spring element is clamped at respective end points whilst an intermediate area between the end points is subjected to elastic deformation caused by the lever.

2. Locking system according to claim 1, wherein the contact surfaces are separated by a gap, amounting to a multiple of a diameter of the spring element.

3. Locking system according to claim 1, wherein the at least one stable position comprises two stable positions at opposite ends of the predetermined pivoting angle range, and the deflection surface deflects the spring element on one side between the two stable positions, whilst the spring element in the respective stable position is generally not deflected.

4. Locking system according to claim 1, wherein in the range of a tipping point of the lever the spring element is subjected to a maximum one-sided deflection.

5. Locking system according to claim 4, wherein the at least one stable position comprises two stable positions at opposite ends of the predetermined pivoting angle range, and the tipping point centered in relation to the predetermined pivoting angle range is located between the two stable positions.

6. Locking system according to claim 1, wherein the lever is moveable in an overtravel range beyond the at least one stable position, and in the overtravel range, beyond the stable position, the spring element is subjected to deflection on two sides.

7. Locking system according to claim 6, wherein in the overtravel range, the spring element is S-shaped.

8. Locking system according to claim 1, wherein the spring element is produced from a straight spring wire.

9. Locking system according to claim 1, wherein the lever is designed as a pivoting lever mounted on an axis.

10. Locking system according to claim 1, wherein the lever contains a motorized drive.

11. Locking system according to claim 1, further comprising a drive, wherein the lever including the drive is designed as a worm gear drive used for driving at least one of a locking lever or a theft-protection lever of a motor vehicle door lock.

* * * * *